United States Patent [19]

Nemoto

[11] 4,373,876

[45] Feb. 15, 1983

[54] DOUBLE-ACTING PISTON COMPRESSOR

[75] Inventor: Akira Nemoto, Toyohashi, Japan

[73] Assignee: Musashi Seimitsu Kogyo Kabushiki Kaisha, Aichi, Japan

[21] Appl. No.: 161,258

[22] Filed: Jun. 20, 1980

[30] Foreign Application Priority Data

Mar. 21, 1980 [JP] Japan ..... 55-36645

[51] Int. Cl.[3] ..... F04B 39/00; F04B 39/10

[52] U.S. Cl. ..... 417/534; 417/539

[58] Field of Search ..... 417/534, 535, 529, 536, 417/537, 539; 74/50

[56] References Cited

U.S. PATENT DOCUMENTS

| | | | |
|---|---|---|---|
| 1,912,926 | 6/1933 | Wegener | 417/534 |
| 2,488,846 | 11/1949 | Bergendal | 74/50 |
| 2,771,037 | 11/1956 | Johnston | 417/536 X |
| 3,010,644 | 11/1961 | Zeidler | 417/534 |
| 3,456,874 | 7/1969 | Graper | 417/534 |
| 3,458,121 | 7/1969 | Gleason, Jr. | 230/232 |
| 3,834,840 | 9/1974 | Hartley | 417/535 |
| 3,871,793 | 3/1975 | Olson, Jr. | 417/534 X |
| 4,132,510 | 1/1979 | Takahashi | 417/534 |

FOREIGN PATENT DOCUMENTS

| | | | |
|---|---|---|---|
| 835919 | 4/1952 | Fed. Rep. of Germany | 417/534 |
| 1234915 | 8/1967 | Fed. Rep. of Germany . | |
| 2903786 | 8/1979 | Fed. Rep. of Germany | 417/534 |

*Primary Examiner*—William L. Freeh

*Attorney, Agent, or Firm*—Ladas & Parry

[57] ABSTRACT

An easy-to-assemble compressor having a pair of parallel, double-headed pistons reciprocably mounted in respective cylinder chambers in a compressor housing. The pistons are mounted on a crankshaft via Scotch-yoke-type sliders slidably engaged in the respective pistons for reciprocating movement in a direction normal to the piston axis. The sliders convert the rotation of the crankshaft into linear reciprocation of the pistons. The dimensions of these sliders are determined in relation to the other parts of the compressor so that, during the assemblage of the compressor, the sliders may be mounted in position by being passed over the opposite end portions of the crankshaft following the mounting of the pistons and crankshaft within the housing.

5 Claims, 16 Drawing Figures

DOUBLE-ACTING PISTON COMPRESSOR

BACKGROUND OF THE INVENTION

This invention relates to compressors, to positive-displacement compressors, and to double-acting piston compressors. The invention is directed more specifically to such a compressor having a pair of parallel, double-headed pistons reciprocably mounted in a common housing or cylinder block. The compressor according to the invention finds use, for example, as a refrigerant compressor in an automotive air conditioning system.

U.S. Pat. No. 3,797,969, issued to Weatherhead et al. on Mar. 19, 1974, describes and claims a refrigerant compressor of the double-acting piston type herein under consideration. The compressor comprises a pair of double-headed pistons reciprocably fitted in respective cylinder chambers defined by a common housing. A crankshaft extending transversely through the cylinder chambers has a pair of offset cranks, one for each piston, on which there are mounted Scotch-yoke-type sliders slidably fitted in transverse passages or tracks in the respective pistons. The sliders function to transform the rotation of the crankshaft into rectilinear reciprocation of the pistons.

Each slider used in such a double-acting piston cylinder is usually more or less rectangular in shape, having a bore, complete with a bushing or equivalent means, extending centrally therethrough. At least two opposite surfaces of the slider are parallel for sliding contact with one of the pistons. The sliders are referred to as the unitary type, in contradistinction to a split type.

The configuration of a double-acting piston compressor with such unitary sliders depends in no small measure upon the manner in which the sliders are mounted in position during the assemblage of the compressor. The sliders must rotatably fit over the cranks of the crankshaft and further must be slidably received in the transverse passages in the pistons for linear reciprocation. All these sliders, crankshaft and pistons, moreover, must be operably mounted within the compressor housing. Thus the manner of assemblage of the compressor not only determines its size and weight but also materially affects the machinability of its parts and the durability of the apparatus. A more detailed discussion of problems involved in compressor configuration and assemblage follows.

The mounting of the unitary sliders on the cranks has heretofore required that the cranks be considerably larger in diameter than the other crankshaft portions. Such large diameter cranks necessitate the use of sliders having bores of correspondingly great diameter so that the sliders may pass over the end portions of the crankshaft onto its crank. The crankshaft portions other than the cranks should not be made unduly slender, however. For the crankshaft with such slender portions would deflect during compressor operation, thus giving rise to mechanical vibration, noise, and rapid wear of sliding parts.

Should the cranks be of excessively great diameter, on the other hand, the external size of the sliders would increase correspondingly. Such large sliders would not be mounted in position without a corresponding increase in the spacing between the side columns joining the opposed heads of each piston. Since the pistons as a whole should preferably be of generally cylindrical shape, however, the increase in the spacing between the side columns would demand a decrease in their thickness and, therefore, strength if the piston diameter was to remain unchanged.

Several other approaches have been suggested for mounting the unitary sliders in position. Such known approaches include:

1. To make detachable two of the four side columns of each piston, thereby making it possible to move the sliders into the pistons without decreasing the thickness of the columns.

2. To split each piston into halves along a plane perpendicular to its axis.

3. To increase the axial length of each piston and to make the side columns project beyond the diameter of the piston heads, thereby making possible the mounting of the sliders and further increasing the strength of the side columns.

All these conventional approaches have one or more of such drawbacks as lower machinability of the required parts, less precision with which the parts are assembled, and greater bulk of the resulting compressor.

Another known slider mounting method calls for the splitting of the crankshaft into cranks and other shaft portions. This method not only makes it easy to mount the sliders in position but also permits reduction of the crank diameter to a minimum, resulting in the provision of a compact compressor. These advantages are offset, however, by the lower rigidity and less accurate dimensions of the assembled crankshaft. The durability of a compressor with such a split crankshaft is also questionable.

The foregoing study of the prior art will have made clear that if the double-acting piston compressor of the type under consideration is to employ unitary sliders, at least either of the housing, pistons, and crankshaft has had to be of the split type in order to keep the size of the compressor at a desired minimum. The use of such split parts involves the noted problems in strength and accuracy of dimensions.

SUMMARY OF THE INVENTION

The present invention seeks to overcome the above difficulties of the prior art and to provide an improved double-acting piston compressor which employs unitary or nonsplit parts alone but which permits easy assemblage of such parts. In attaining this objective, moreover, the invention makes no sacrifice of mechanical strength, compactness, or machinability of the parts.

The compressor according to the invention has a pair of double-headed pistons reciprocably mounted in respective cylinder chambers defined by a housing. Each piston has formed therethrough a first and a second passage arranged crosswise with respect to each other and each extending normal to the piston axis. Having two cranks, one for each piston, a crankshaft is rotatably supported at its opposite end journals and extends through the first passages in the pistons. A pair of unitary sliders are each rotatably fitted over one of the cranks and each reciprocably mounted in the second passage in one of the pistons for converting the rotation of the crankshaft into rectilinear reciprocation of the pistons.

Further, in accordance with the invention, the dimensions of the sliders are determined as follows in relation to the other parts of the compressor:

1. The diameter of an opening in each of the opposite ends of the housing is greater than the maximum dimension of each slider as measured in a plane normal to its axis.

2. The dimension of the first passage in each piston as measured in the direction of the reciprocating movement of each slider along the second passage therein is greater than the maximum dimension of the slider as measured in the same direction.

3. The dimension of the first and second passages in each piston as measured in its axial direction is equal to or slightly more than the dimension of each slider as measured in the same direction.

4. The axial dimension of each outer shaft portion of the crankshaft, extending between one of its oppsite end journals and the adjacent one of the cranks, is greater than the axial dimension of each slider.

Thus, in the assemblage of the compressor, the sliders of the above dimensions can be mounted in position as they are inserted into the housing through its end openings and passed over the opposite end portions of the crankshaft after the pistons and crankshaft have been mounted in the housing. The sliders, pistons, and crankshaft can all be of the unitary type, so that they are easy to fabricate and further contribute to the strength and durability of the machine.

According to a further feature of the invention each outer shaft portion of the crankshaft is formed to include a part, preferably in the form of a semicylinder, such that when either of the sliders has its inside surface held against the same, the slider is in axial alignment with the adjacent one of the cranks. The slider may then be simply slid onto the adjacent crank to be mounted in position. This feature makes it possible to reduce the diameter of the cranks without decreasing the rigidity of the crankshaft as a whole, while permitting the unitary sliders to be mounted on the cranks. Such small diameter cranks allow the use of correspondingly small sliders and, therefore, pistons having thick, sturdy side columns, within the housing of minimum size.

The above and other features and advantages of this invention will become more apparent, and the invention itself will best be understood, from the following description taken in connection with the attached drawings.

DESCRIPTION OF THE PREFERRED EMBODIMENT

Figure 1:
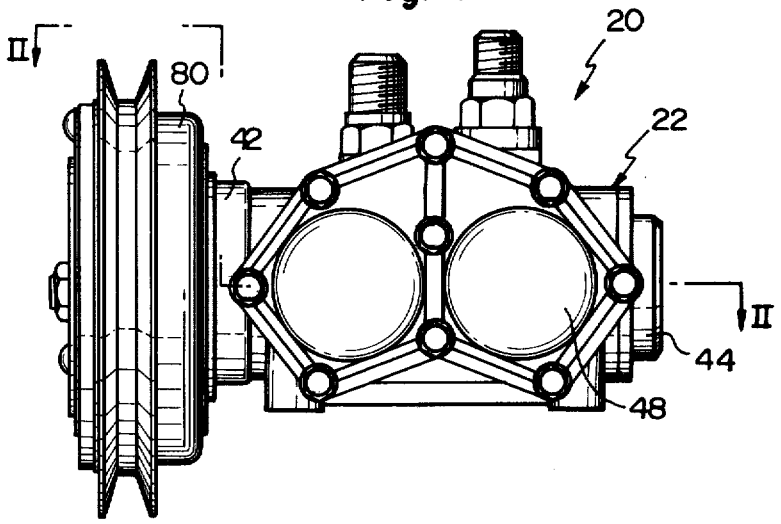
FIG. 1 is an elevational view of a double-acting piston compressor constructed in accordance with the present invention.
Figure 2:
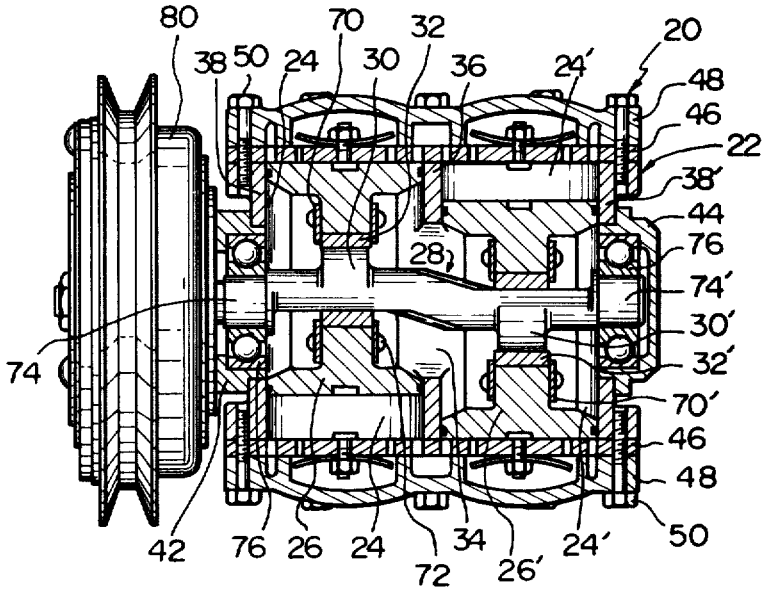
FIG. 2 is a sectional view of the compressor taken along the line II—II of FIG. 1.
Figure 3:
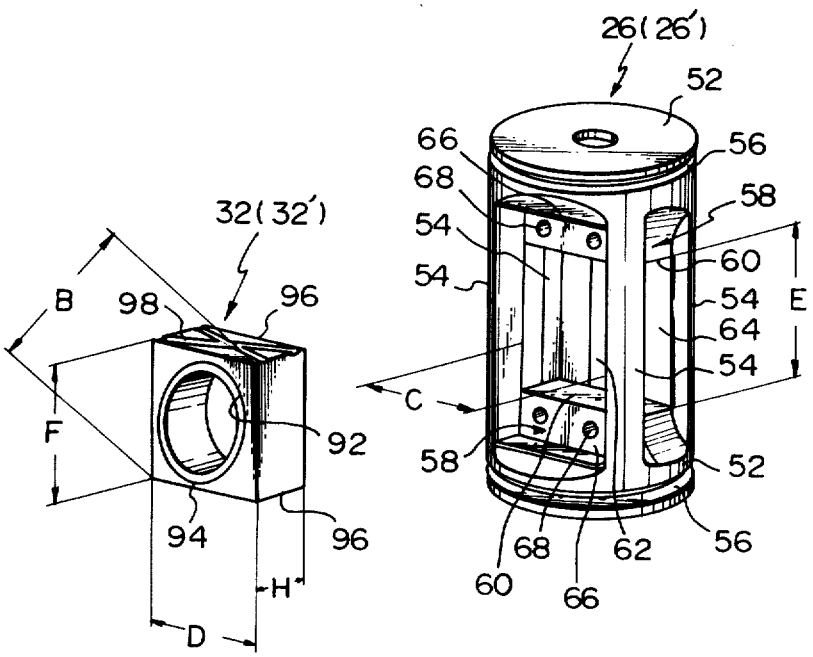
FIG. 3 is an enlarged perspective view of one of the pistons and one of the sliders in the compressor of FIG. 1, the piston and slider being shown separated from each other and from the other parts of the compressor.

The drawings illustrate the present invention as adapted specifically for use as a refrigerant compressor for automotive air conditioning systems. With particular reference to FIGS. 1 through 3 the refrigerant compressor, generally designated 20, broadly comprises:

1. A housing or cylinder block 22 defining a pair of cylinder chambers 24 and 24' parallel to each other.

2. A pair of double-headed pistons 26 and 26' slidably mounted in the respective cylinder chambers 24 and 24' for linear reciprocation.

3. A crankshaft 28 having two cranks 30 and 30', one for each piston, and rotatably mounted in the housing 22 so as to extend across the pistons 26 and 26'.

4. A pair of sliders 32 and 32' rotatably fitted over the respective cranks 30 and 30' of the crankshaft 28 and slidably engaged with the respective pistons 26 and 26' for imparting reciprocating movement to the pistons upon rotation of the crankshaft.

Figure 4:
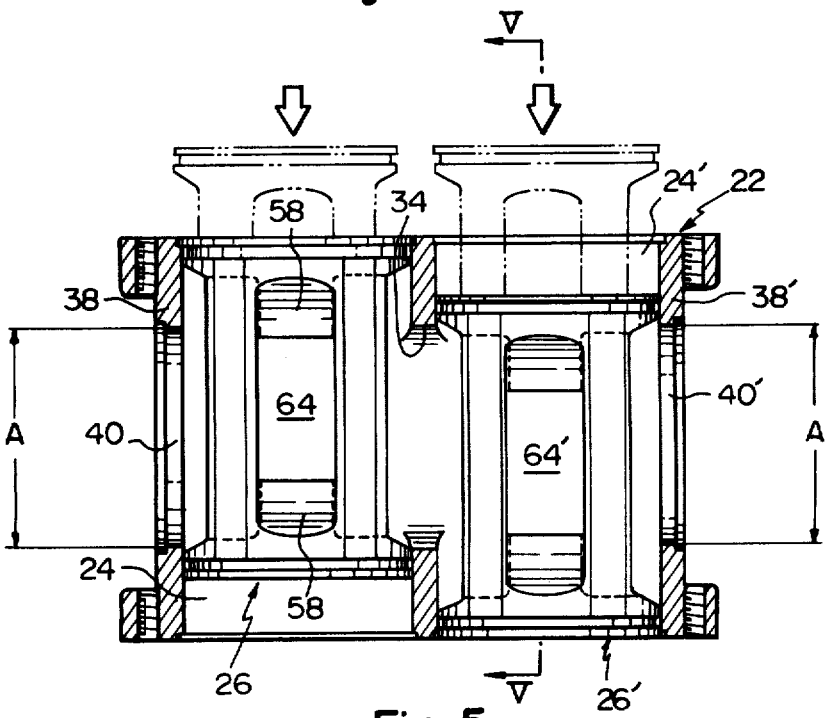
FIG. 4 is a sectional view, taken along the same plane as FIG. 2, explanatory of the way in which the pistons are inserted into the housing in the assemblage of the compressor of FIG. 1.
Figure 5:
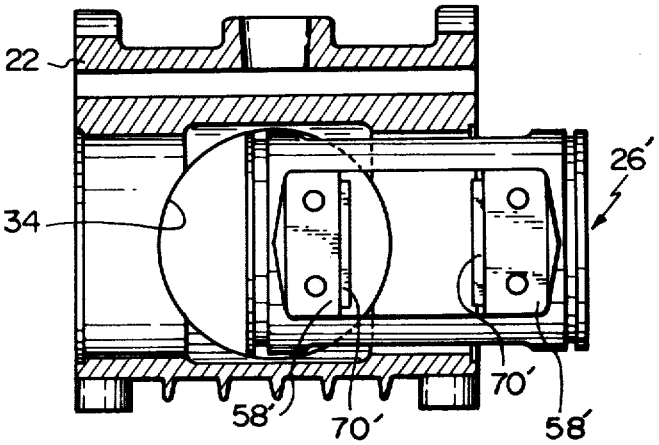
FIG. 5 is a sectional view taken along the line V—V of FIG. 4.

As shown also in FIGS. 4 and 5, the compressor housing 22 is an integral die casting of steel or aluminum-base alloy, finished by cutting and grinding operations. The pair of cylinder chambers 24 and 24' in the housing 22 is laterally open to each other through an opening 34 in a partition 36, in order to permit the crankshaft 28 to extend transversely through the cylinder chambers. The housing 22 is stripped of all unessential portions to reduce its weight to a minimum.

The opposite end walls 38 and 38' of the housing 22 has formed therein a pair of circular openings or holes 40 and 40' in axial alignment with each other. The crankshaft 28 and the pair of sliders 32 and 32' are inserted into the housing 22 through these openings 40 and 40' during the assemblage of the compressor 20, as will be later explained in more detail. End covers 42 and 44 are closely fitted in the respective openings 40 and 40'.

Closing the opposite ends of the cylinder chambers 24 and 24' are valve seats 46 each having suction and discharge valves as shown in FIG. 1. Valve covers or manifolds 48 are fastened to the housing 22 via the valve seats 46, as by cap screws 50. The pistons 26 and 26' are to be inserted into the respective cylinder chambers 24 and 24' prior to the mounting of the valve seats 46 and the valve covers 48.

The pair of double-headed pistons 26 and 26' are both of identical make. Only the piston 26 will therefore be described in detail with particular reference to FIG. 3, it being understood that the same description applies to the other piston 26'. Parts of the piston 26' will be identified merely by priming the reference numerals used to denote the corresponding parts of the piston 26.

The piston 26 is preferably a die casting of aluminum alloy, integrally comprising a pair of piston heads 52 at its opposite ends, and four side columns or struts 54 joining the piston heads. When viewed from either end of the piston 26, the outer surfaces of the side columns 54 form the arcs of a circle bounding the piston heads 52, so that the piston can be thought of as being generally of cylindrical shape. Each piston head 52 has an annular groove 56 formed therein for closely receiving a sealing ring, not shown in FIG. 3, which may be of usual steel or synthetic resin material.

Located inside the four side columns 54 of the piston 26, and extending from the piston heads 52 toward each other, are a pair of main guides 58 having opposed, parallel surfaces 60 oriented normal to the piston axis. The slider 32 is to be mounted, slidably and without play, between the opposed guide surfaces 60 for reciprocating movement in a direction normal to the longitudinal direction of the crankshaft 28 extending therethrough. It is thus seen that the four side columns 54 and pair of main guides 58 of the piston 26 define in combination first and second passages 62 and 64 arranged crosswise with respect to each other and both extending perpendicular to the piston axis. The crankshaft 28 extends through the first passage 62, and the slider 32 slidingly reciprocates along the second passage 64.

The two opposite sides 66 of each main guide 58, extending along the second passage 64, are recessed for the desired lighter weight of the piston 26 and formed into vertical surfaces parallel to each other. Formed in these sides 66 of the main guides 58 are screwholes 68 for use in fastening side guide plates 70 to the main guides 58 by screws 72. The side guide plates 70 function to constrain the slider 32 to reciprocating movement along the second passage 64.

With reference back to FIG. 2 the crankshaft 28 has the two cranks 30 and 30' angularly offset 180° from each other. Preferably made of steel, the crankshaft 28 is subsequently hardened, as by carburizing or induction hardening, so that the surface hardness of at least its cranks 30 and 30' ranges from 58 to 62 Rockwell "C". The crankshaft 28 has its opposite ends formed into journals 74 and 74', with the cranks 30 and 30' being spaced inboard from the respective journals. Two bearings 76, each mounted in one of the end covers 42 and 44 of the housing 22, rotatably support the journals 74 and 74' of the crankshaft 28. A shaft extension 78 (FIG. 6). extends from the left hand journal 74 for connection of the crankshaft 28 to a suitable drive such as a vehicle engine, not shown, via an electromagnetic clutch 80.

The crankshaft 28 further comprises an inner, offset shaft portion 82 extending between the cranks 30 and 30', and a pair of outer shaft portions 84 and 84' extending respectively between the cranks 30 and 30' and the adjacent journals 74 and 74'. The outer shaft portion 84 (and also the other outer shaft portion 84') includes a first semicylinder 86 (86'), a second semicylinder 88 (88'), and a flange 90 (90'). The first semicylinder 86 (86') of the outer shaft portion 84 (84') is centered at the same axis, and has the same radius, as the adjacent crank 30 (30'). The second semicylinder 88 (88') and flange 90 (90') of the outer shaft portion 84 (84') are centered at approximately the same axis as, and have a slightly greater radius than, the journal 74 (74'). Located at the outboard end of the outer shaft portion 84 (84'), the flange 90 (90') functions as a stop restraining each bearing 76 from inward movement.

The pair of sliders 32 and 32' are also of identical construction, so that only one of them, 32, will be described in detail with particular reference to FIG. 3. Parts of the other slider 32' will be identified by priming the reference numerals used to represent the corresponding parts of the slider 32.

The slider 32 is of generally boxlike shape, having a bore 92 extending centrally therethrough. The bore 92 is lined with a bushing 94 to rotatably fit over the crank 30 of the crankshaft 28. The bushing 94 should withstand abrasion, should not seize to the steel-made crank 30, and should offer little or no frictional resistance. Bronze, lead bronze, and aluminum alloy represent some of the possible bushing materials meeting all the above requirements. Alternatively the bushing 94 may be of steel, complete with a lining of bronze, lead bronze, or aluminum alloy.

The slider 32 proper, on the other hand, can be usually made solely of steel. At least its opposite contact surfaces 96, however, should be hardened so as to withstand abrasion, not to seize to the piston 26 of aluminum alloy, and to offer little or no frictional resistance. The hardness of these contact surfaces 96 should preferably be made 58–62 Rockwell "C" as by carburizing, induction hardening, or laser hardening. Each contact surface 96 is shown to have two lubricant grooves 98 formed crosswise therein, each groove extending substantially in the direction of slider movement within the piston 26.

In the refrigerant compressor 20 of the above organization, the invention specifies the dimensions of each of the sliders 32 and 32' as in the following in relation to the other pertinent parts of the compressor. The following description of such dimensional specifications will deal with only the slider 32 and the parts directly associated therewith, with the understanding that the same description applies to the other slider 32' and the parts directly associated therewith.

First of all, the diameter A (FIG. 4) of the opening 40 in the end wall 38 of the housing 22 is greater than the maximum dimension B (FIG. 3) of the slider 32 as measured in a plane normal to the axis of the slider. Thus the sliders 32 and 32' can be inserted into the housing 22 through its end openings 40 and 40'.

The width C (FIG. 3) of the first passage 62 in the piston 26, as measured in the direction in which the slider 32 reciprocates (i.e., the longitudinal direction of the second passage 64 in the piston), is slightly more than the dimension D of the slider as measured in the same direction. Further the height E of the first and second passages 62 and 64 in the piston 26 (i.e., the dimension of the passages as measured in the axial direction of the piston, or the distance between the opposed surfaces 60 of the main guide pair 58) is equal to or only slightly more than the height F of the slider 32 as measured in the axial direction of the piston 26.

It is thus seen that the slider 32 can be mounted in the piston 26 through either end of its first passage 62. During the assemblage of the compressor 20, therefore, the slider 32 can be placed in the second passage 64 of the piston 26 by being passed over the crankshaft 28 in its axial direction, the crankshaft being configured and dimensioned to permit such axial movement of the slider thereover, as will be detailed presently. Although the first passage 62 in the piston 26 is sufficiently large to permit the slider 32 to pass therethrough, as above explained, nevertheless the side columns 54 of the piston are large enough in cross sectional size to join the pair of piston heads 52 with a required degree of strength.

The axial dimension G (FIG. 6) of the outer shaft portion 84, excluding its flange 90, of the crankshaft 28 is equal to or slightly more than the axial dimension H (FIG. 3) of the slider 32. In mounting the slider 32 on the crank 30 of the crankshaft 28, therefore, the slider is first placed on its outer shaft portion 84. The inside surface of the slider 32 is then held closely against the first semicylinder 86 of the outer shaft portion 84. Since the first semicylinder 86 is centered at the same axis, and has the same radius, as the adjacent crank 30, as aforesaid, and since the slider bushing 94 has substantially the same inside diameter as the diameter of the crank 30, the slider 32 is then in axial alignment with the crank 30.

It is of course understood that the axial dimension H of the slider 32 is less than the spacing between each pair of guide plates 70 on the piston 26. This spacing between each guide plate pair is less than the spacing between each pair of side columns 54 opposed to each other in the axial direction of the slider 32. The slider 32 is thus allowed to reciprocate in the second passage 64 of the piston 26 without colliding with its side columns 54.

Figure 6:
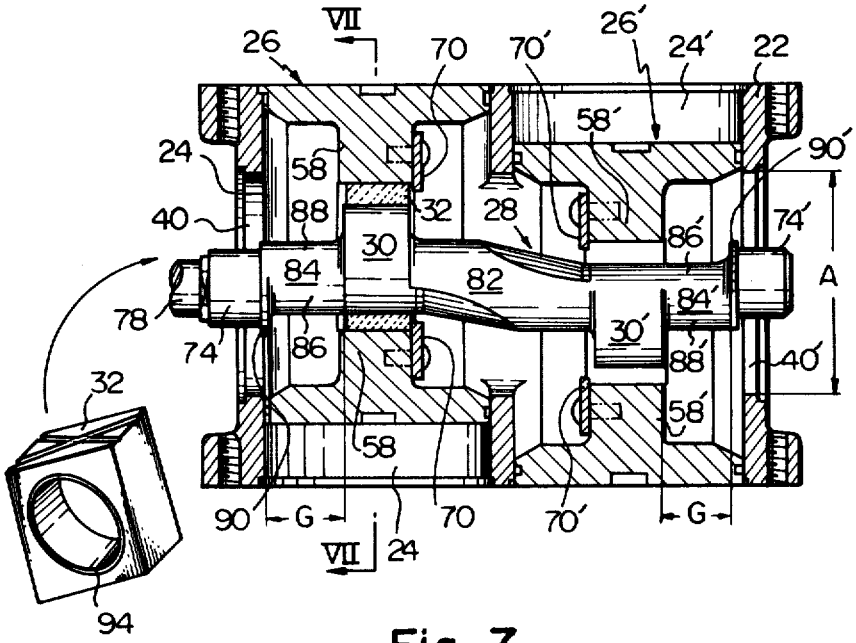
FIG. 6 is a view similar to FIG. 4 but further showing the crankshaft mounted in position across the pistons, the view being further explanatory of the way in which one of the sliders is mounted in place in the compressor.
Figure 7:
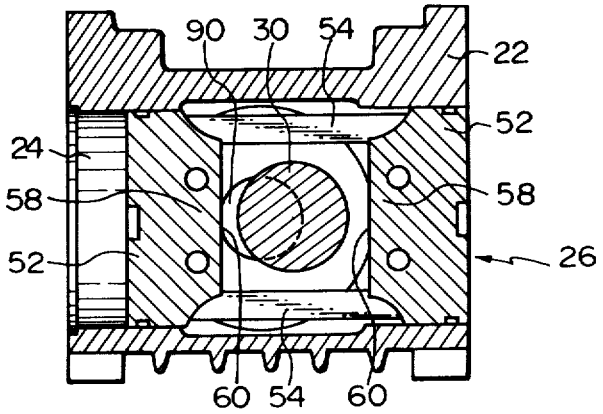
FIG. 7 is a sectional view taken along the line VII—VII of FIG. 6.

Described below is the manner of assemblage of the refrigerant compressor 20 constructed and dimensioned as in the foregoing. The assemblage of the compressor starts with the insertion of the two double-headed pistons 26 and 26' into the respective cylinder chambers 24 and 24' of the housing 22, as shown in FIGS. 4 and 5. The inboard side guide plates 70 and 70' must previously be screwed to the main guides 58 and 58' of the pistons 26 and 26', as best seen in FIG. 6. Then, as shown in FIGS. 6 and 7, the crankshaft 28 is inserted transversely into and through the cylinder chambers 24 and 24' through either of the end openings 40 and 40' in the housing 22. The crankshaft 28 is passed through the first passages 62 and 62' in the pistons 26 and 26' and is stopped as its cranks 30 and 30' come into register with the pistons as in FIG. 6.

Next comes the step of mounting the sliders 32 and 32' on the cranks 30 and 30' of the crankshaft 28 within the pistons 26 and 26'. Alternatively, however, either of the sliders 32 and 32' may be mounted on the corresponding one of the cranks 30 and 30' of the crankshaft 28 prior to the insertion of this crankshaft into the housing 22. The slider 32 or 32' on the corresponding crank 30 or 30' can be placed in the corresponding piston 26 or 26' as the crankshaft 28 is subsequently inserted into the housing 22 and passed through the first passages 62 and 62' in the pistons. Then the other slider, whichever it is, can be mounted in position by the following method, which will be illustrated and described on the assumption that the left hand slider 32 has already been mounted in place by being inserted into the housing 22 together with the crankshaft 28.

Figure 8:
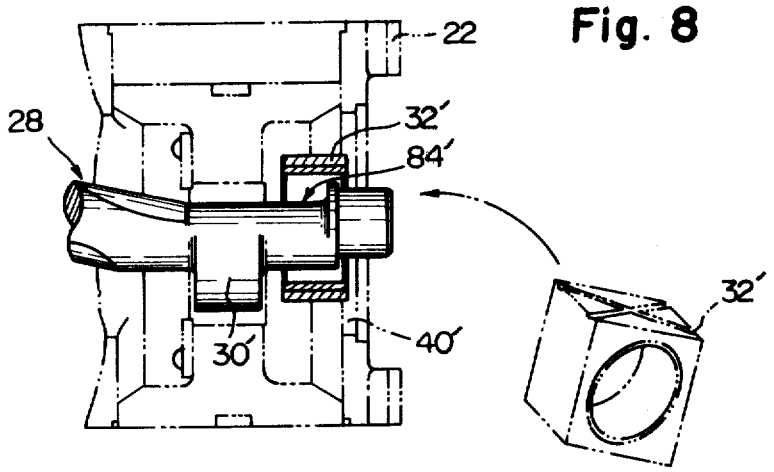
FIG. 8 is a partial sectional view, somewhat similar to FIG. 4, explanatory of the way in which the other slider is being passed over one end of the crankshaft in order to be mounted in position in the compressor.

The right hand slider 32' is first inserted into the housing 22 through its right hand end opening 40', receiving the right hand end portion of the crankshaft 28 in its central bore, as pictured in FIG. 8. The slider 32' is moved into the housing 22 until it lies over the right hand outer shaft portion 84' of the crankshaft 28.

Figure 9:
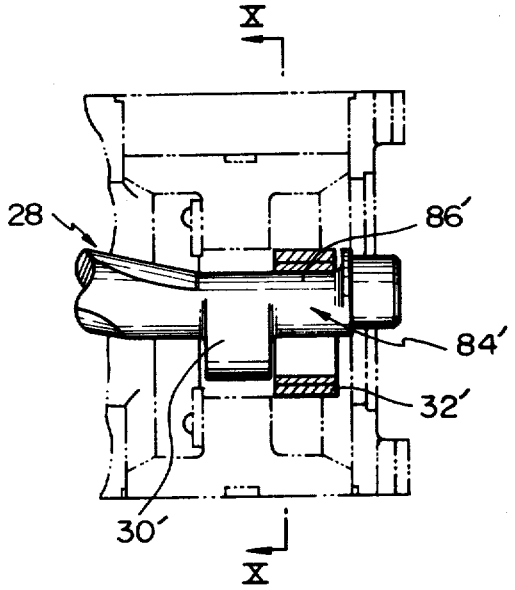
FIG. 9 is a view similar to FIG. 8 but showing the slider subsequently placed in contact with one of the outer shaft portions of the crankshaft so as to be in axial alignment with the adjacent crank of the crankshaft.
Figure 10:
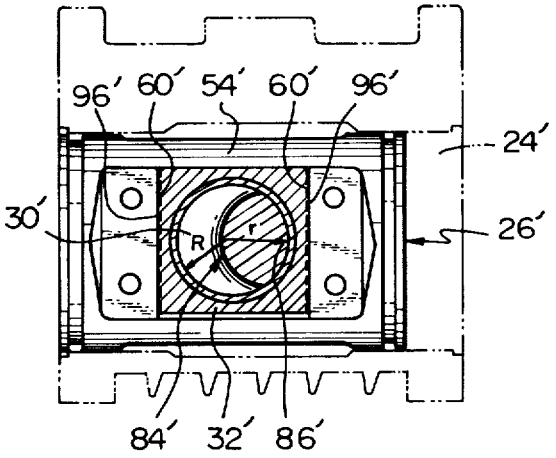
FIG. 10 is a sectional view taken along the line X—X of FIG. 9.

Then, as depicted in FIGS. 9 and 10, the inside surface of the slider 32' is held against the first semicylinder 86' of the outer crankshaft portion 84', having a radius r. The slider 32' is now in axial alignment with the right hand crank 30' (having a radius R) of the crankshaft 28.

Figure 11:
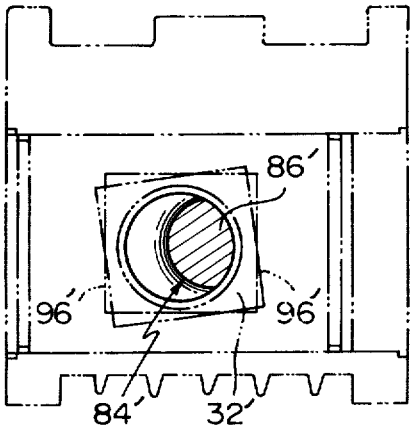
FIG. 11 is a view similar to FIG. 10 but explanatory of the way in which the slider is turned about the outer shaft portion of the crankshaft so as to be in correct angular relationship to the piston in which the slider is to be mounted.

As shown in FIG. 11, the slider 32' is then turned as required about the outer crankshaft portion 84', with the inside surface of the slider maintained in contact with the first semicylinder 86', in order to bring the opposite contact surfaces 96' of the slider into parallel relationship with the opposed guide surfaces 60' of the piston 26'. Then the slider 32' is held sidewise against either of the two adjacent side columns 54' of the piston 26', as will be seen upon inspection of FIG. 10.

If the contact surfaces 96' of the slider 32' are not in coplanar relationship to the respective guide surfaces 60' of the piston 26', adjustment may be effected either by moving the piston 26' axially in the cylinder chamber 24' or by moving the crankshaft 28, together with the slider 32' thereon, in the axial direction of the piston. The slider 32' is now ready to be slid over the crank 30' of the crankshaft 28 and into the space between the opposed guide surfaces 60' of the piston 26'.

Figure 12:
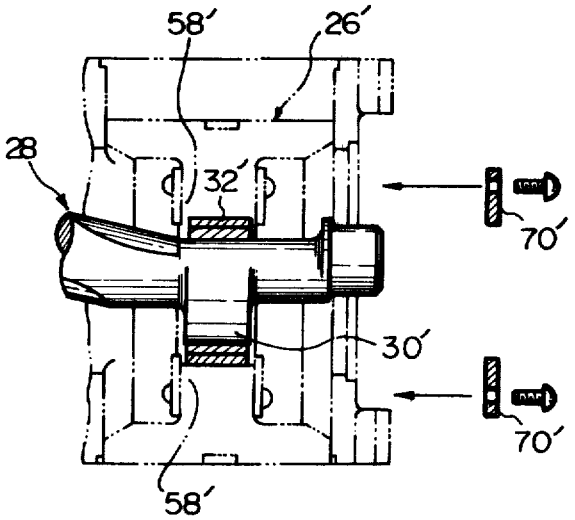
FIG. 12 is a view similar to FIGS. 8 and 9 but showing the slider mounted in position.

FIG. 12 shows the slider 32' properly installed between the crank 30' of the crankshaft 28 and the opposed main guides 58' of the piston 26', with the right hand side guide plates 70' subsequently screwed to the main guides 58' to prevent lateral displacement of the slider in use. If the left hand slider 32 has not been inserted into the housing 22 together with the crankshaft 28, the slider 32 is subsequently mounted in position through the same procedure as above. Thereafter the bearings 76, the end covers 42 and 44, the valve seats 46 and associated valve assemblies, etc., are mounted in positions in any convenient manner to complete the assemblage of the refrigerant compressor 20.

The operational description of the compressor follows. The two cranks 30 and 30' move in a circular path as rotation is imparted to the crankshaft 28 via the electromagnetic clutch 80. The sliders 32 and 32' on the cranks 30 and 30' are constrained to linear reciprocation along the second passages 64 and 64' in the pistons 26 and 26', whereas these pistons are themselves confined to linear reciprocation in the cylinder chambers 24 and 24'. The linear reciprocation of the sliders 32 and 32' in the second passages 64 and 64' serves to cancel the horizontal component of the crank rotation. The sliders transfer only the vertical component of the crank rotation to the pistons 26 and 26'.

Thus the pistons 26 and 26' alternately move up and down in the cylinder chambers 24 and 24' with the rotation of the crankshaft 28. In so doing the pistons draw in and discharge a refrigerant gas, thereby supplying the compressed refrigerant needed by the vehicle air conditioning system.

Figure 13:
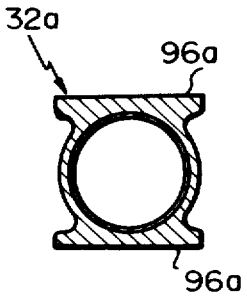
FIG. 13 is a cross sectional view of a modified slider for use in the compressor of FIG. 1.
Figure 14:
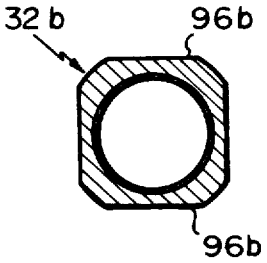
FIG. 14 is a cross sectional view of another modified slider for use in the compressor of FIG. 1.

The preferred embodiment described hereinbefore permits a variety of modifications and variations. For example, the sliders 32 and 32' may not necessarily be of exactly rectangular shape but may be shaped like modified sliders 32*a* and 32*b* shown in FIGS. 13 and 14. Such modified sliders, however, should have parallel surfaces 96*a* and 96*b* at its opposite ends for sliding contact with the opposed guide surfaces of the pistons. Further the sliders may be fitted with needle roller bearings instead of the illustrated bushings.

Figure 15:
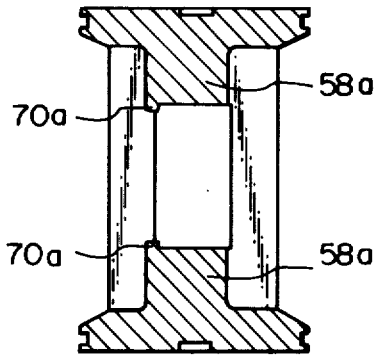
FIG. 15 is an axial sectional view of a modified piston for use in the compressor of FIG. 1.

It will also be seen that the use of the separate side guide plates 70 and 70' is not of absolute necessity on the inboard sides of the main guides 58 and 58' of the pistons 26 and 26'. As shown in FIG. 15, therefore, each piston may be formed integral with inboard side guide rims 70*a* on its main guides 58*a*. Separate guide plates are of course to be fastened to the outboard sides of these main guides 58*a* following the mounting of the slider therebetween.

Figure 16:
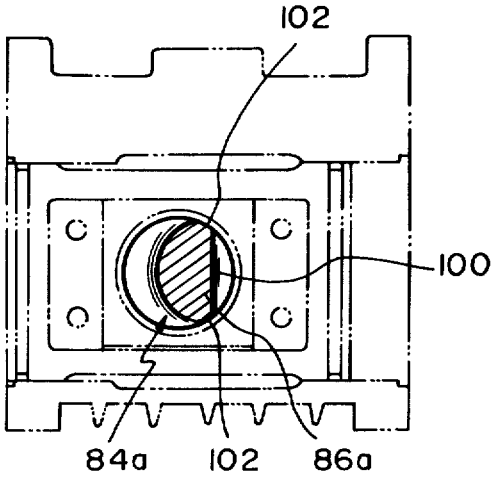
FIG. 16 is a view corresponding to FIG. 10 but showing in particular a modified outer shaft portion of the crankshaft.

Still further the first semicylinders 86 and 86' of the outer crankshaft portions 84 and 84' may not necessarily be of exactly semicylindrical shape, it only being necessary that the sliders placed on these semicylinders be in axial alignment with the adjacent cranks. FIG. 16 shows a modified outer crankshaft portion 84*a*, with a recess 100 formed in its first semicylinder 86*a*. The remaining arcuate surface portions 102 of the recessed semicylinder 86*a* serve to position the slider in axial alignment with the adjacent crank.

The scope of this invention encompasses all these and other modifications and variations that will readily occur to the specialists.

What is claimed is:

1. An easy-to-assemble, positive-displacement, double-acting compressor comprising:

(a) a housing defining a pair of parallel cylinder chambers laterally open to each other, the housing having a pair of openings formed in its opposite ends;

(b) a pair of double-headed pistons reciprocably mounted one in each cylinder chamber, each piston having four side columns extending between two piston heads to form through the piston a first and a second passage arranged crosswise with respect to each other and both extending normal to the axis of the piston;

(c) a crankshaft rotatably mounted in the housing and extending through the first passages in the pistons, the crankshaft comprising a pair of journals at opposite ends thereof, a pair of cranks spaced inboard from the journals, and a pair of outer shaft portions each extending between one of the journals and the adjacent one of the cranks;

(d) a pair of sliders each rotatably fitted over one of the cranks and each reciprocably mounted in the second passage in one of the pistons, the sliders being effective to translate the rotation of the crankshaft into linear reciprocation of the pistons, at least one of said sliders being fitted over one of the cranks, after the pistons are inserted in the respective cylinder chambers and then the crankshaft is passed through the first passages in the pistons to a position at which the crank is in register with the pistons, by inserting the slider into the housing through the opening thereof so as to cause it to lie over the outer shaft portion of the crankshaft and then shifting the slider axially of the crankshaft into the second passage of the piston and onto the crank;

(e) a pair of valve seats closing the opposite ends of the cylinder chambers to define fluid compression chambers between the valve seats and the piston heads;

(f) means forming fluid intake chambers from which fluid is supplied into the fluid compression chambers to be compressed therein; and (g) means forming fluid discharge chambers outside the valve seats, into which discharge chambers compressed fluid is supplied from the associated compression chambers;

(h) there being the following dimensional relations between the sliders and the other parts of the compressor:

$$A > B,\ C > D,\ E \geqq F, \text{ and } G > H$$

wherein

A is the diameter of each of the openings in the opposite ends of the housing,

B is the maximum dimension of each slider as measured in a plane normal to its axis, C is the dimension of the first passage in each piston as measured in the direction of movement of each slider along the second passage in the piston, D is the maximum dimension of each slider as measured in the direction of its movement along the second passage in each piston, E is the dimension of the first and second passages in each piston as measured in the axial direction of the piston, F is the dimension of each slider as measured in the axial direction of each piston, G is the axial dimension of each outer shaft portion of the crankshaft, and H is the axial dimension of each slider.

2. A compressor according to claim 1, wherein each outer shaft portion of the crankshaft is formed to include a part such that when one of the sliders is placed thereon, the slider is in axial alignment with the adjacent one of the cranks.

3. A compressor according to claim 2, wherein the part of each outer shaft portion of the crankshaft is in the form of a semicylinder centered at the same axis, and having the same radius, as the adjacent one of the cranks.

4. A compressor according to claim 1, wherein the second passage in each piston is defined by a pair of opposed main guides formed integral with the piston and by a pair of side guides on the inboard and outboard sides of each main guide, at least the outboard side guides being adapted to be secured to the main guides after the sliders are mounted in position.

5. A compressor according to claim 4, wherein the inboard side guides of each piston are formed integral therewith.

* * * * *